United States Patent [19]

Tanaka

[11] Patent Number: 5,000,105

[45] Date of Patent: Mar. 19, 1991

[54] EDGE TRACING SEWING MACHINE

[75] Inventor: Takafumi Tanaka, Nagoya, Japan

[73] Assignee: Brother Kogyo Kabushiki Kaisha, Japan

[21] Appl. No.: 525,839

[22] Filed: May 21, 1990

[30] Foreign Application Priority Data

Jul. 18, 1989 [JP] Japan ..... 1-185652

[51] Int. Cl.[5] ..... D05B 3/02

[52] U.S. Cl. ..... 112/453; 112/153; 112/275; 112/306

[58] Field of Search ..... 112/453, 153, 456, 457, 112/306, 121.11, 275

[56] References Cited

U.S. PATENT DOCUMENTS

| | | | |
|---|---|---|---|
| 4,664,048 | 5/1987 | Naganuma et al. | 112/453 |
| 4,742,789 | 5/1988 | Pestel et al. | 112/153 X |
| 4,823,716 | 4/1989 | Nakashima | 112/453 |
| 4,827,858 | 5/1989 | Hurie | 112/153 X |
| 4,869,189 | 9/1989 | Horie | 112/453 |

FOREIGN PATENT DOCUMENTS

| | | |
|---|---|---|
| 62-68482 | 9/1985 | Japan . |
| 61-257675 | 11/1986 | Japan . |
| 63-277090 | 5/1987 | Japan . |

*Primary Examiner*—Peter Nerbun
*Attorney, Agent, or Firm*—Oliff & Berridge

[57] ABSTRACT

An edge tracing sewing machine includes a reciprocable needle bar having a needle at a lower end, a needle position sensor for detecting needle-down position, a presser bar having a presser foot at a lower end, a presser foot switch for detecting an upper position of the presser foot, a vertical feed driving device, a forward feed driving device for feeding a work fabric in a sewing direction, a lateral feed driving device for feeding the work fabric in a lateral direction perpendicular to the sewing direction, a fabric-edge position detector, a tracing width setting device, and a control device. The control device controls the lateral feed driving device based on signals from the fabric-edge position detector and the tracing width setting device, so as to carry out a tracing sewing with the tracing width set by the tracing width setting device. The control device nullifies the forward feed driving device and controls the lateral feed device based on signals from the needle position sensor and the presser foot switch. Accordingly, the difference between a distance from an edge of a work fabric to the needle and the tracing width set by the tracing width setting device is reduced after the work fabric is rotated in a vicinity of a corner of the work fabric to change the sewing direction.

19 Claims, 12 Drawing Sheets

EDGE TRACING SEWING MACHINE

BACKGROUND OF THE INVENTION

1. Field of the Invention

This invention relates to a sewing, and more particularly to a sewing machine having a fabric-edge tracing function.

2. Description of the Prior Art

Fabric-edge tracing sewing machines are already known wherein stitches are formed along a line spaced by a predetermined distance from an edge of a workpiece or work fabric.

One of such fabric-edge tracing sewing machines is disclosed, for example, in Japanese Patent Laid-Open No. 221389/1987 filed by the assignee of the present patent application wherein a fabric-edge detector is controlled so as to follow an edge of a work fabric and stitches are formed at a position spaced by a preset tracing width form an edge of a work fabric.

Conventionally, when a corner of a work fabric is to be traced on a sewing machine, an operator will stop tracing sewing at a lowered position of a needle near a mark applied to a predetermined location of the work fabric at which an angle is to be made by lines of stitches of tracing sewing, and then turn the work fabric in a predetermined direction around the needle whereafter tracing sewing is resumed. In this case, a conventional tracing sewing machine is controlled, when the tracing width upon resuming of tracing sewing is not equal to a preset tracing width, such that the difference in tracing width is gradually corrected in several stitches after resuming of such tracing sewing.

Since a difference in tracing width at a corner of a work fabric is gradually corrected in several stitches as described just above, stitches at the corner will be partially deformed. Consequently, such problems possibly take place that, when a fabric is turned inside out, for example, after plain seaming of a collar end is finished, the angle of the collar end is not formed neatly, that stitches at an angle do not trace an edge of a work fabric accurately so the quality of a product executed by such tracing sewing is reduced.

SUMMARY OF THE INVENTION

It is an object of the present invention to provide a fabric-edge tracing sewing machine wherein, when tracing sewing at a corner of a work fabric is performed, stitches are not deformed and tracing sewing of a high quality can be accomplished.

The above object can be achieved, according to the present invention, by a sewing machine which comprises: a reciprocable needle bar having a needle at a lower end thereof; feeding means for feeding a workpiece in a sewing direction synchronously with a reciprocation of said needle bar; relative position changing means for changing relative position between the needle and the workpiece in a lateral direction perpendicular to the sewing direction; edge position detecting means for detecting an edge position of the workpiece in the lateral direction, and generating an edge position signal; tracing width setting means for setting a tracing width from the edge of the workpiece to the needle in the lateral direction; first control means for controlling said relative position changing means based on the edge position signal generated by said edge position detecting means and the tracing width set by said tracing width setting means, so as to carry out a tracing sewing with the set tracing width; interruption detecting means for detecting an interruption of the tracing sewing in a vicinity of a corner portion of the workpiece so as to rotate the workpiece and to change the sewing direction; and second control means for nullifying said feeding means and controlling said relative position changing means based on the edge position signal generated by said edge position detecting means and the tracing width set by said tracing width setting means after the interruption of the tracing sewing is detected by said interruption detecting means, wherein a difference between a distance from the edge of the workpiece to the needle and the set tracing width is reduced.

BRIEF DESCRIPTION OF THE DRAWINGS

A preferred embodiment of the present invention will be described in detail with reference to the following figures wherein.

DETAILED DESCRIPTION OF THE PREFERRED EMBODIMENTS

There will now be described a preferred embodiment of the present invention with reference to the drawings, in which the present invention is applied to an electronically controlled zigzag sewing machine.

Figure 1:
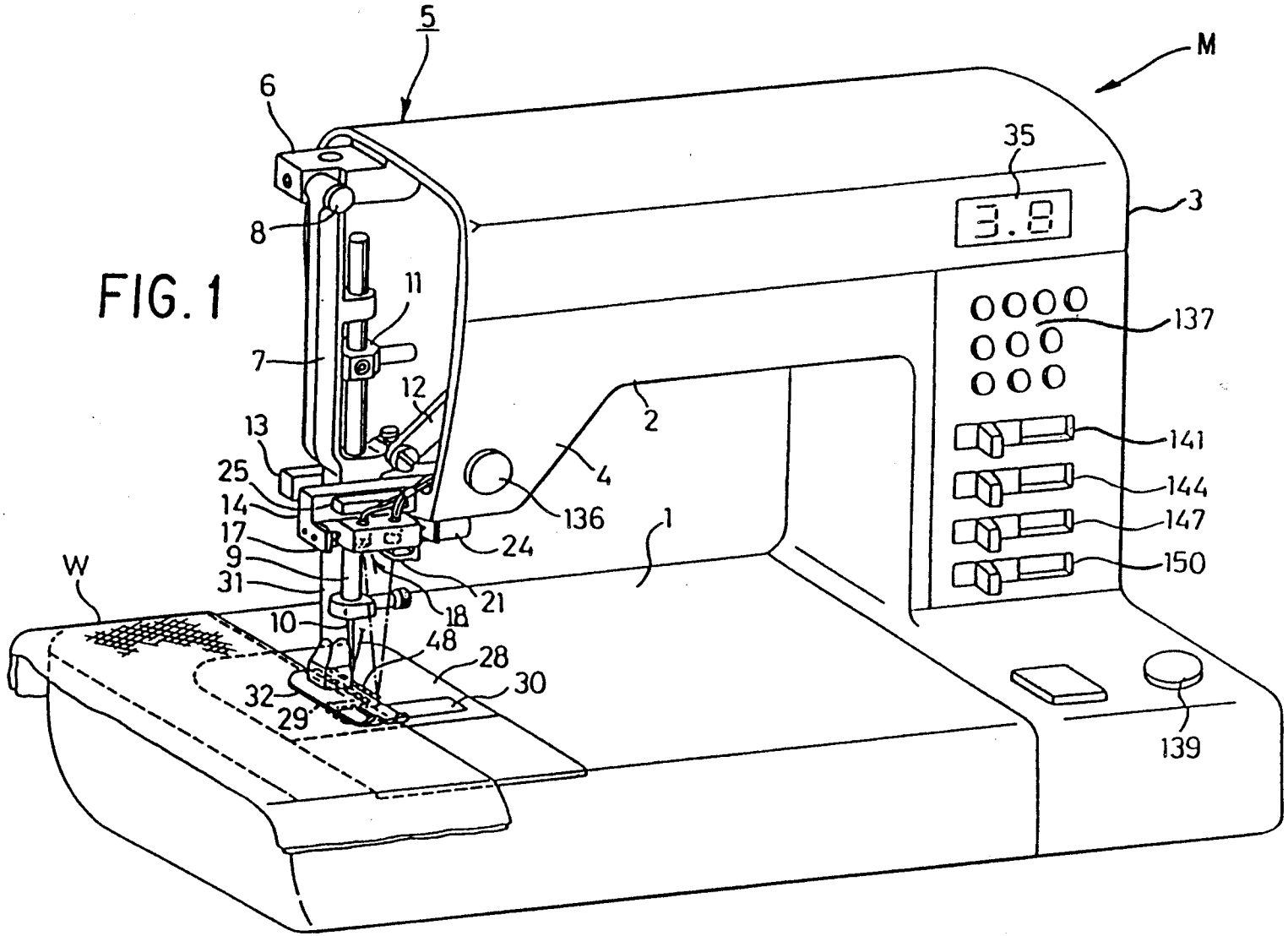
FIG. 1 is a perspective view of the sewing machine, showing an internal mechanism of a head of the sewing machine.
Figure 3:
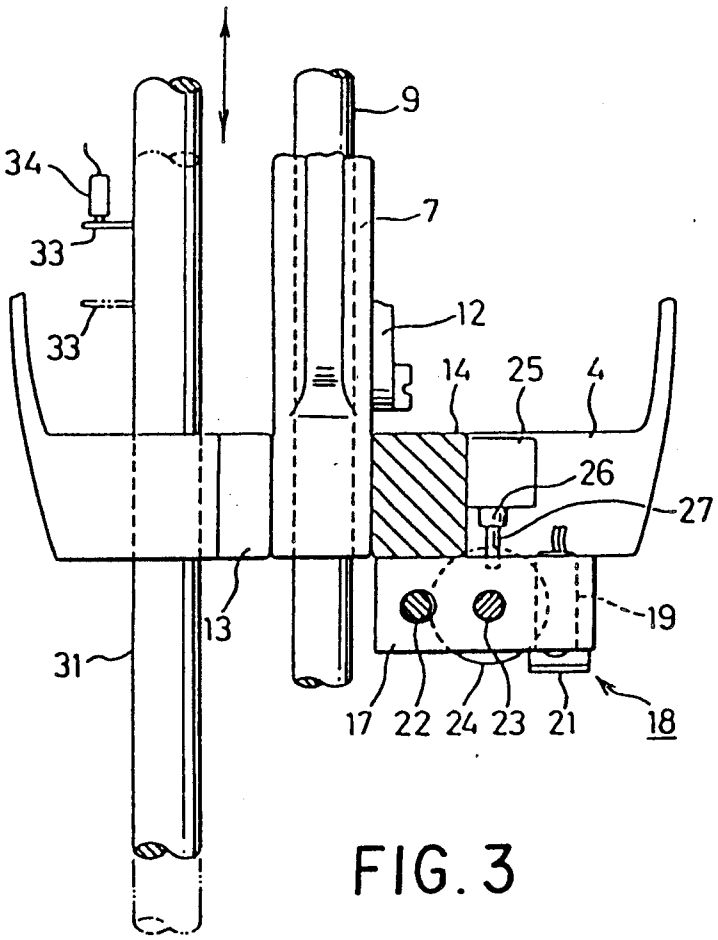
FIG. 3 is a cross section taken along the line III—III in FIG. 2.
Figure 2:
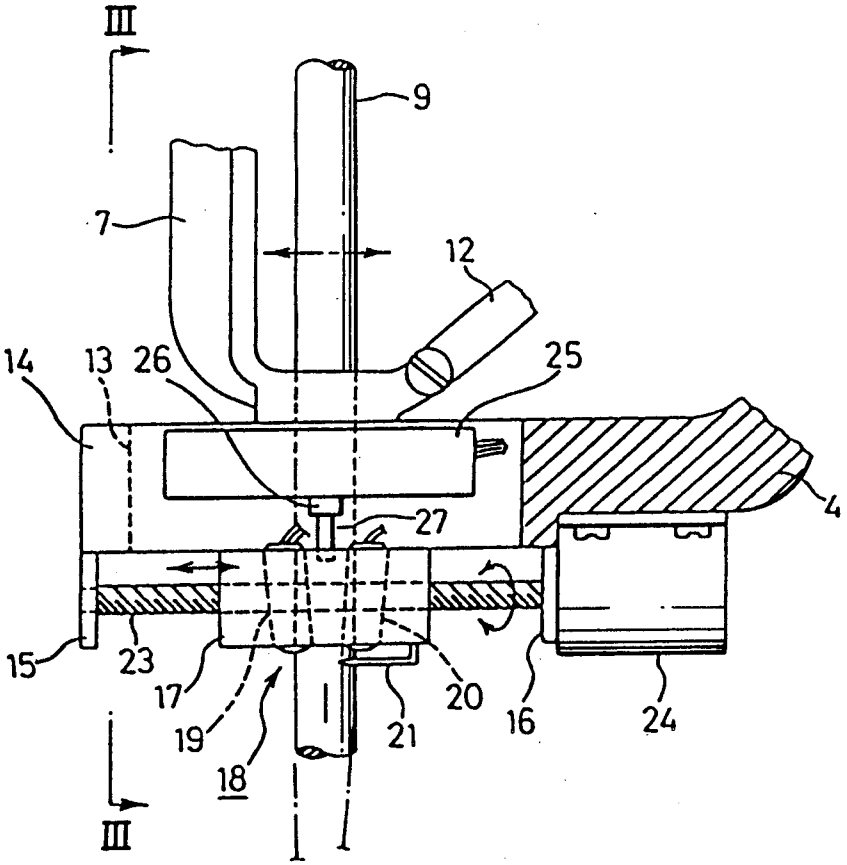
FIG. 2 is a vertical sectional view of an essential part of the head.

Referring to FIGS. 1 to 3, a device for vertically driving a needle bar 9 and a device for swingably driving the needle bar 9 are incorporated in an arm 2 of a sewing machine M. These devices are similar to those of a usual zigzag sewing machine, and a general construction thereof will now be described. A needle bar support 7 is swingably supported at its upper end by a pivot pin 8 to a supporting portion 6 fixed to a head 4. The needle bar 9 is vertically movably supported on the needle bar support 7, and a needle 10 is attached to the lower end of the needle bar 9. The needle bar 9 is connected through a needle bar connecting stud 11, an arm shaft 44, etc. to a main motor 155 (see FIG. 12). The needle bar 9 and the needle 10 are vertically reciprocated by rotating the main motor 155. The lower end portion of the needle bar support 7 is connected through a connecting rod 12 to a stepping motor 135 for swinging a needle bar (see FIG. 12). The needle 10 is swung through the needle bar 9 by driving the stepping motor 135.

A presser bar 31 is located just behind the needle bar 9. The presser bar 31 is supported on a machine frame 5 in such a manner that a position of the presser bar 31 can be selected by an operating member (not shown) between an upper position as shown by a solid line in FIG. 3 and a lower position as shown by a imaginary line in FIG. 3 where a work fabric W is pressed between a feed dog 48 and a presser foot 32 supported on a lower end of the presser bar 31. A pin 33 is fixed to the midway portion of the presser bar 31. When the presser bar 31 is operated to select the upper position, the pin 33 abuts against a presser foot switch 34 fixed to the machine frame 5 to operate the presser foot switch 34.

A fabric-edge detecting device will now be described. Guide members 13 and 14 fixed to the head 4 are located just behind and before the lower end portion of the needle bar support 7, respectively, in such a manner as to extend horizontally leftwardly from the head 4. That is, the lower end portion of the needle bar support 7 is held and guided between the guide members 13 and 14. A fabric-edge sensor 18 includes a light emitter 19 for emitting infrared rays and a photoelectric cell 20 for receiving a reflected beam of the infrared rays. The light emitter 19 and the photoelectric cell 20 are mounted in a supporting member 17 in such a manner as to be inclined at a predetermined angle in symmetrical relationship in a horizontal direction as viewed in FIG. 2. An optical filter 21 permitting passage of the infrared rays only is fixed to the supporting member 17 at a position just below the photoelectric cell 20. Behind the light emitter 19 and the photoelectric cell 20,a guide shaft 22 extending in the horizontal direction as viewed in FIG. 2 is inserted through the supporting member 17, and a feed screw 23 extending in the horizontal direction parallel to the guide shaft 22 is threadedly engaged in the supporting member 17. The left ends of the guide shaft 22 and the feed screw 23 are rotatably supported on a mounting member 15 fixed to the guide member 14, while the right ends of the guide shaft 22 and the feed screw 23 are also rotatably supported on a mounting member 16 fixed to the guide member 14. The right end of the feed screw 23 is fixed to a driving shaft of a fabric-edge detecting motor 24 mounted to the head 4. Accordingly, when the feed screw 23 is rotated by the motor 24, the supporting member 17 is moved right and left between both the mounting members 15 and 16.

A fabric-edge position detector 25 constructed as a slide type variable resistor is fixed to the guide member 14 at a position just above the supporting member 17. A slider 26 of the fabric-edge position detector 25 is connected to a connecting projection 27 projecting upwardly from the supporting member 17. Accordingly, when the supporting member 17 is moved right and left to thereby move the slider 26, the fabric-edge position detector 25 generates a fabric-edge position voltage Vd corresponding to the present position of the fabric-edge sensor 18.

A throat plate 28 disposed on a bed 1 is formed with a needle hole 29 elongated in a longitudinal direction of the bed 1 for permitting passage of the needle 10. The throat plate 28 is further formed with a rectangular reflecting surface 30 opposed to the supporting member 17, so that the infrared rays emitted from the light emitter 19 are reflected by the reflecting surface 30, and the reflected light is received by the photoelectric cell 20. The photoelectric cell 20 generates a detection voltage Vs corresponding to a quantity of the infrared rays reflected by the reflecting surface 30.

The head 4 is provided with a start/stop button 136 for starting or stopping a sewing operation. A column part 3 of the machine frame 5 is provided with a pattern select switch 137 constructed as a ten-key switch for selecting a desired sewing pattern, a feed pitch adjusting knob 141 for adjusting a feed pitch of the work fabric W, a needle swing amount adjusting knob 144 for adjusting a swing quantity of the needle 10, a speed adjusting knob 147 for setting a sewing speed, a tracing width setting knob 150 for setting a tracing width between the edge of the work fabric W and a line of stitches to be formed on the work fabric W, a tracing button 139 for commanding a tracing operation, and a display panel 35 for displaying a set value of the tracing width.

Figure 6:
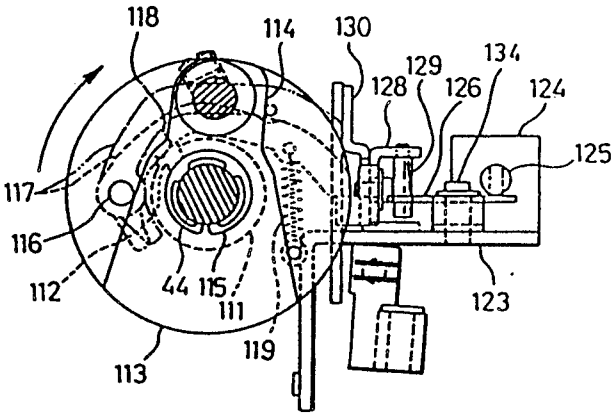
FIG. 6 is a cross section taken along the line VI—VI in FIG. 5.

There will now be described a needle bar clutch mechanism 110 for temporarily stopping the vertical reciprocation of the needle bar 9, with reference to FIGS. 4 to 6.

A cylindrical set collar 111 is mounted on the arm shaft 44 extending longitudinally in the arm 2 and adapted to be rotated by the main motor 155, and is fixed by a screw in the vicinity of the left end portion of the arm shaft 44. An outer circumference of the set collar 111 is partially formed with a recess 112 extending along an axial full length of the set collar 111. A crank disc 113 is rotatably mounted on the left end portion of the set collar 111. A thread take-up crank 114 is rotatably mounted on the arm shaft 44 in such a manner as to abut against the left end surfaces of the set collar 111 and the crank disc 113. The crank disc 113 is fixed to the thread take-up crank 114, and the thread take-up crank 114 is prevented from disengaging from the arm shaft 44 by means of a stop ring 115 mounted on the left end portion of the arm shaft 44.

A curved clutch plate 117 is pivotably supported at its base portion to the right side surface of the crank disc 113 by a pin 116 fixed to the crank disc 113 in such a manner as to be rotatable in a plane perpendicular to the arm shaft 44. The clutch plate 117 is formed near its base portion with a projection 118 engageable with the recess 112 of the set collar 111. The clutch plate 117 is biased by a tension spring 119 in a direction such that the projection 118 comes into engagement with the recess 112. Accordingly, when the recess 112 is brought into engagement with the projection 118 by the rotation of the arm shaft 44, the clutch plate 117 is rotated to thereby rotate the crank disc 113 and the thread take-up crank 114. A needle bar crank 120 is connected to a crank pin 121 mounted on the thread take-up crank 114. Reference numeral 122 designates a thread take-up lever.

A solenoid 124 elongated in the longitudinal direction of the arm shaft 44 is fixed on a mounting plate 123 fixed to the machine frame 5. An output shaft 125 of the solenoid 124 is connected to the base portion of a rotating lever 126 rotatably mounted through a pin 134 to the mounting plate 123. A forked portion 127 formed at the end portion of the rotating lever 126 is engaged with a pin 129 fixed to a slide plate 128. A pair of pins 131 are mounted on a supporting plate 130 fixed to the mounting plate 123, and the pins 131 are engaged with a pair of elongated holes 132 formed through the slide plate 128. Thus, the vertical and rotational movements of the slide plate 128 are restricted by the pins 131, and only the horizontal movement of the slide plate 128 along the supporting plate 130 is permitted. Further, a tension spring 133 is connected between the slide plate 128 and the supporting plate 130 to normally bias the slide plate 128 rightward.

Figure 4:
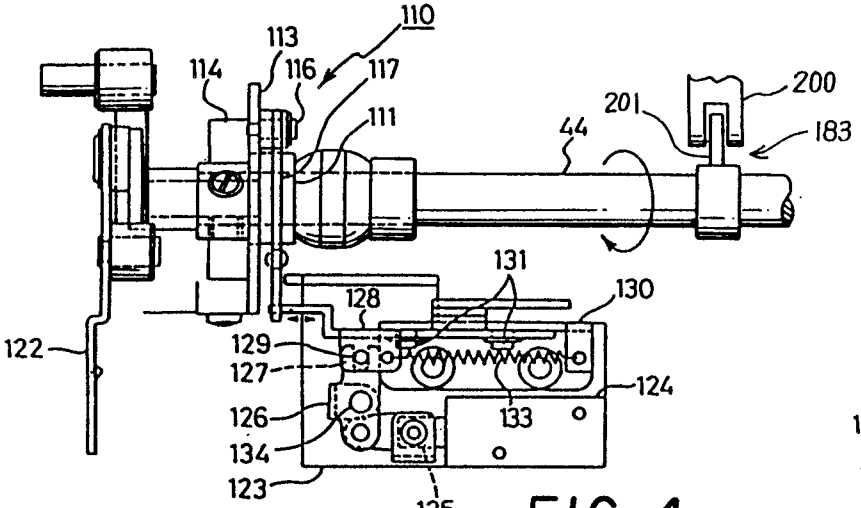
FIG. 4 is a top plan view of a needle bar clutch mechanism.
Figure 5:
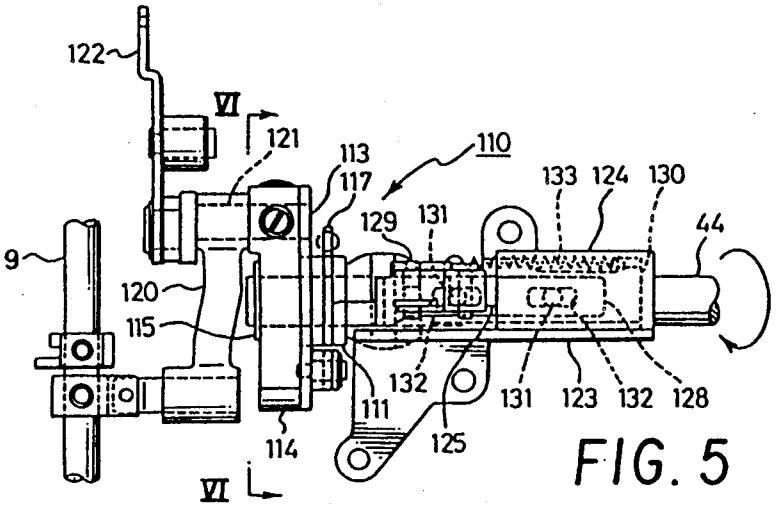
FIG. 5 is a front elevational view of the needle bar clutch mechanism shown in FIG. 4.

When the solenoid 124 is driven during rotation of the arm shaft 44, the rotating lever 126 is rotated counterclockwise as viewed in FIG. 4 against a biasing force of the spring 133. The counterclockwise rotation of the rotating lever 126 causes leftward movement of the slide plate 128 to an operative position where the end portion of the clutch plate 117 abuts against the end portion of the slide plate 128 when the needle bar 9 is in a substantially uppermost position. Thereafter, the clutch plate 117 is rotated to an inoperative position as shown by a two-dot chain line in FIG. 6 by the rotation of the arm shaft 44. As a result, the engagement of the projection 118 with the recess 112 is released, thereby maintaining the needle bar 9 in the uppermost position irrespective of the rotation of the arm shaft 44. When the solenoid 124 is de-energized, the slide plate 128 is returned to its original or inoperative position by the biasing force of the spring 133. Then, when the arm shaft 44 comes to a phase of substantially zero degree, the clutch plate 117 is returned to its original or operative position by the biasing force of the spring 119 to thereby engage the projection 118 with the recess 112 again, thus restarting the vertical reciprocation of the needle bar 9.

A needle position sensor 183 for detecting a needle-up position and a needle-down position of the needle 10 will now be described. As shown in FIG. 4, the needle position sensor 183 includes a photointerrupter 200 fixed in the arm 2 and a sectional shielding plate 201 fixed to the arm shaft 44. The shielding plate 201 is formed in an angular range of the arm shaft 44 corresponding to the needle-up position. Accordingly, when the needle 10 is in the needle-up position, the photointerrupter 200 is shielded by the shielding plate 201, and a needle-up signal at a low level is therefore outputted from the photointerrupter 200. On the other hand, when the needle 10 is in the needle-down position, the photointerrupter 200 is not shielded by the shielding plate 201, and a needle-down signal at a high level is therefore outputted from the photointerrupter 200.

There will not be described a vertical feed driving device and a forward feed driving device provided in the bed 1 with reference to FIGS. 7 to 11.

A planar base plate 40 extending in a longitudinal direction of the bed 1 is disposed in the vicinity of the bottom portion of the bed 1, and is fixed to the machine frame 5. A lower shaft 41 extending in the longitudinal direction of the bed 1 is located at the substantially central position of the bed 1 with respect to the transverse direction thereof and is rotatably supported by a plurality of bearings 42 fixed to the base plate 40 and extending upwardly. A pulley 43 is mounted on the right end portion of the lower shaft 41. A timing belt 45 is wrapped around the pulley 43 and another pulley (not shown) fixed to the arm shaft 44, so that the lower shaft 41 is rotated in synchronism with the arm shaft 44 through the timing belt 45 and the pulley 43 by the rotation of the arm shaft 44.

A channel member 46 having a substantially U-shaped configuration as viewed in elevation and extending in the transverse direction of the bed 1 is fixed to the base plate 40 in the vicinity of the right end portion thereof. A left one of opposite side walls 47 of the channel member 46 projects frontward, and a forward feed stepping motor 49 for moving the feed dog 48 forwardly and reversely is mounted on the left side wall 47. A fixed shaft 50 is disposed in the vicinity of the front end of the base plate 40, and extends from the substantially central position of the base plate 40 in the longitudinal direction thereof to the channel member 46. A left end portion of the fixed shaft 50 is fixed by a screw 52 to a support 51 fixed to the base plate 40, and a right end portion of the fixed shaft 50 is fixed to the right and left side walls 47 of the channel member 46. A first swinging member 53 is formed at its lower portion with a pair of pivotal portions 54, and the fixed shaft 50 is inserted through the pivotal portions 54. Thus, the first swinging member 53 is swingably supported at its pivotal portions 54 to the fixed shaft 50. The first swinging member 53 is further formed at its upper portion with a pair of supporting portions 56, and a shaft 55 disposed in parallel to the fixed shaft 50 is fixed at its opposite ends to the supporting portions 56.

Figure 11:
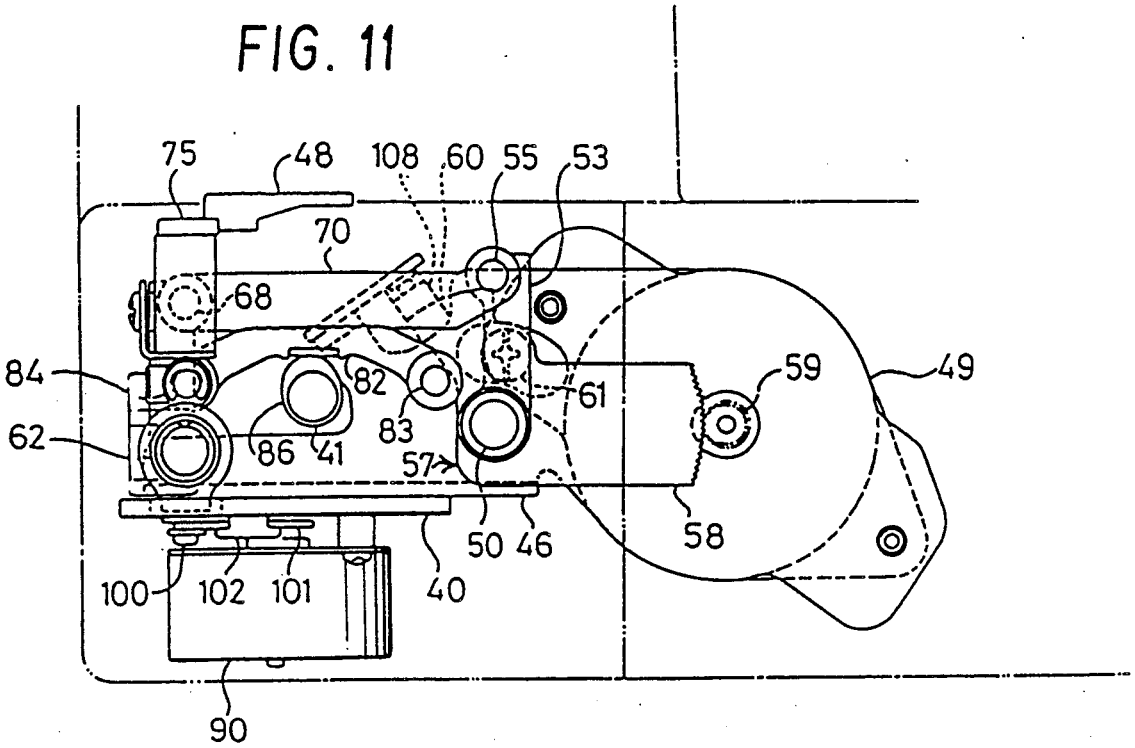
FIG. 11 is a left side view of the internal mechanism shown in FIG. 7.

As shown in FIG. 11, a swinging/driving member 57 having a substantially L-shaped configuration in side view is provided between the first swinging member 53 and the channel member 46, and is rotatably supported on the fixed shaft 50. The swinging/driving member 57 has a driving arm 58 formed at its front end with an arcuate sector gear. This sector gear meshes with a driving gear 59 fixed to the output shaft of the stepping motor 49. Reference numeral 108 designates a sensor for deciding an original position of the swinging/driving member 57. The swinging/driving member 57 has a swinging arm 60 connected to the first swinging member 53 by a screw 61. Accordingly, when the stepping motor 49 is driven, the swinging/driving member 57 and the first swinging member 53 are rotated together about the fixed shaft 50.

Figure 7:
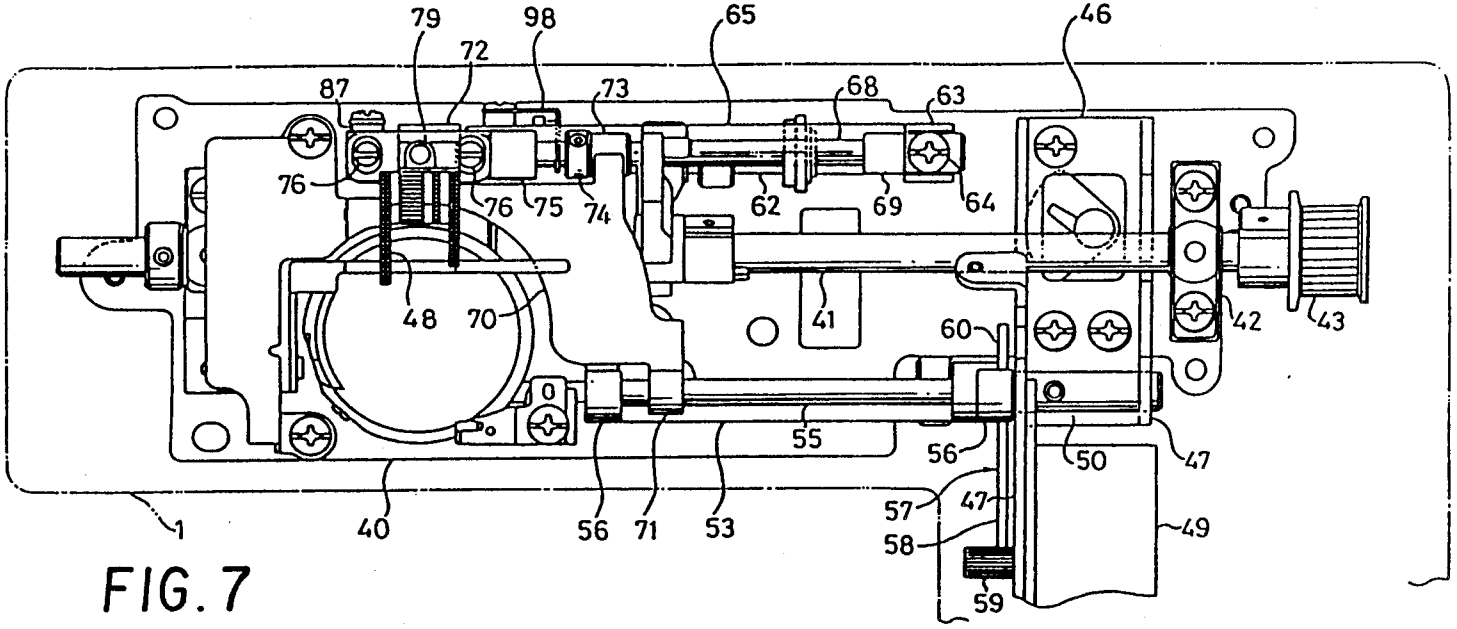
FIG. 7 is a top plan view of an internal mechanism installed in a bed of the sewing machine.
Figure 8:
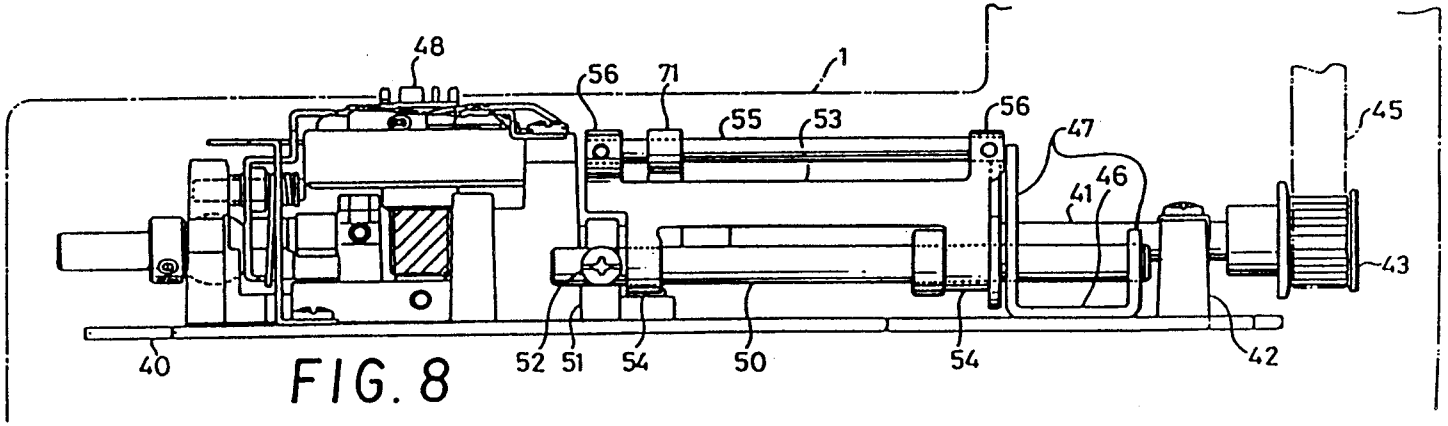
FIG. 8 is a front elevational view of the internal mechanism shown in FIG. 7.
Figure 9:
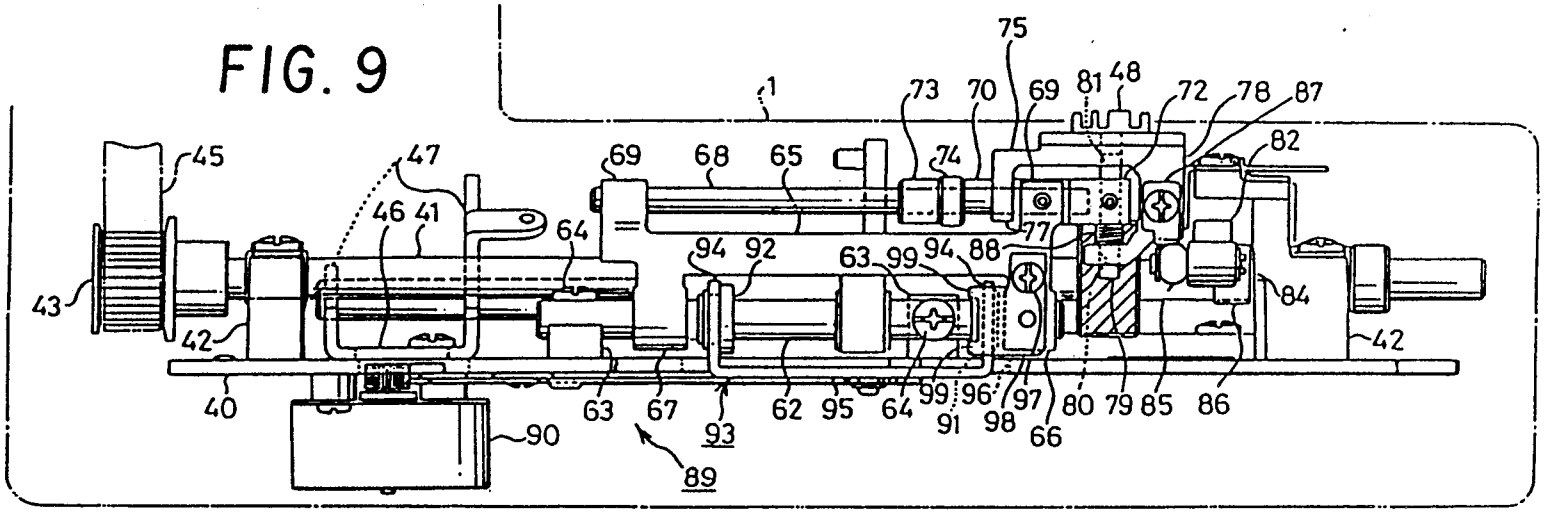
FIG. 9 is a rear elevational view of the internal mechanism shown in FIG. 7.

Referring to FIG. 9, a fixed shaft 62 is disposed in the vicinity of the rear end of the base plate 40, and extends in the longitudinal direction of the base plate 40 at the longitudinally central portion thereof. The fixed shaft 62 is fixed by a screw 64 to a pair of supports 63 fixed to the base plate 40. A second swinging member 65 is formed at its lower portion with a pair of pivotal portions 66 and 67, and the fixed shaft 62 is inserted through the pivotal portions 66 and 67. Thus, the second swinging member 65 is swingably supported at its pivotal portions 66 and 67 to the fixed shaft 62. The second swinging member 65 is further formed at its upper portion with a pair of supporting portions 69, and a shaft 68 disposed in parallel to the fixed shaft 62 is fixed to the supporting portions 69. A connecting member 70 for transmitting a swinging movement of the first swinging member 53 to the second swinging member 65 is formed with three pivotal portions 71, 72 and 73 (FIG. 7). The shaft 55 is inserted through the pivotal portion 73; and a left end portion of the shaft 68 is fitted in the pivotal portion 72. Accordingly, when the first swinging member 53 is swung, the connecting member 70 is moved in the transverse direction of the base plate 40, thereby swinging the second swinging member 65 through the shaft 68. In order to prevent axial movement of the connecting member 70 relative to the shaft 68, a stopper ring 74 abuts against a left end surface of the pivotal portion 73, and is fixed to the shaft 68.

Referring to FIG. 9, the feed dog 48 is fixed to a feed bar 75 by a pair of screws 76. The feed bar 75 is formed at its left end portion with a first leg 77 extending downwardly, and the first leg 77 is formed at its lower end with a U-shaped recess. This U-shaped recess is engaged with the shaft 68 to thereby prevent rotation of the feed bar 75 about a vertical axis. The feed bar 75 is further formed at its right end portion with a second leg 78 extending downwardly and bent horizontally. The second leg 78 is formed at its lower end portion with an insert hole 80 for inserting a vertical driving pin 79. The feed bar 75 and the feed dog 48 are also formed with insert holes 81 adapted to insert the driving pin 79 in opposition to the insert hole 80. The vertical driving pin 79 is inserted through the pivotal portion 72, and is fixed thereto by a screw under the condition where the pin 79 is engaged with the insert holes 80 and 81. Accordingly, when the second swinging member 65 is swung frontward and rearward, the feed dog 48 is moved frontward and rearward through the driving pin 79 and the feed bar 75.

A swinging lever 82 extending in the transverse direction of the base plate 40 is located just on the left side of the feed bar 75 (FIG. 11). The swinging lever 82 is pivotably supported at its front end by a pin 83 to the base plate 40, and a substantially spherical vertical moving member 85 is mounted through a pin 84 to the rear end of the swinging lever 82. An eccentric cam 86 is fixed to the lower shaft 41 at a position opposed to the swinging lever 82, so that the swinging lever 82 is vertically swung about the pin 83 in accordance with a cam profile of the eccentric cam 86 by the rotation of the lower shaft 41. A mounting plate 87 having an L-shaped configuration as viewed from the side is fixed at its vertical portion to the second leg 78 of the feed bar 75 by a screw, and a horizontal portion of the mounting plate 87 is abuttable against the upper surface of the vertical moving member 85. A compression spring 88 is mounted around the driving pin 79 between the pivotal portion 72 and the second leg 78, so as to normally bias the mounting plate 87 against the vertical moving member 85. Accordingly, when the vertical moving member 85 is vertically moved through the swinging lever 82 by the rotation of the lower shaft 41, the feed bar 75 and the feed dog 48 are vertically moved through the mounting plate 87. At the timing when the feed dog 48 is lifted and lowered, the forward/reverse feed stepping motor 49 is driven to forwardly and reversely move the feed dog 48.

A lateral feed driving device 89 will now be described with reference to FIGS. 7 to 11.

Figure 10:
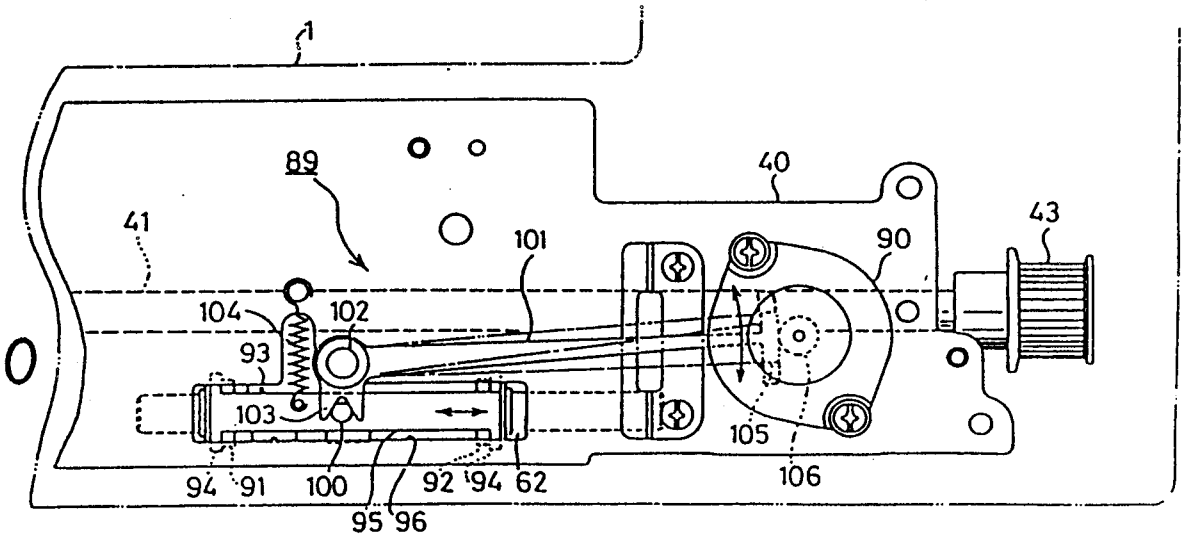
FIG. 10 is a bottom plan view of an essential part of the internal mechanism shown in FIG. 7.

A pair of ring-like slide members 91 and 92 are slidably mounted on the fixed shaft 62, and right and left supporting portions 94 of a movable member 93 having a substantially U-shaped configuration as viewed in elevation are rotatably supported on the slide members 91 and 92. A movable portion 95 of the movable member 93 is located in a rectangular cutout 96 formed through the base plate 40, and the lower end surface of the movable portion 95 projects slightly downwardly from the base plate 40. A left end of the slide member 91 abuts against a right end of the pivotal portion 66 of the second swinging member 65, and a forked portion 99 of a mounting plate 98 fixed to the pivotal portion 66 by a screw 97 is bent frontward at a right end of the slide member 91. Thus, the pivotal portion 66 is integrally connected with the slide member 91. Accordingly, the second swinging member 65 is movable through the pivotal portion 66 in the axial direction of the fixed shaft 62 in synchronism with the movable member 93. On the other hand, as shown in FIG. 10, a pin 100 is fixed to the lower surface of the movable member 93 at the longitudinally central position thereof, and a swinging arm 101 is provided so as to move the pin 100 in the longitudinal direction of the movable member 93.

The swinging arm 101 is pivotably supported at its left end portion by a pin 102 to the base plate 40, and the left end portion is formed with a forked output portion 103 projecting rearwardly. The pin 100 is engaged with the forked output portion 103 by a biasing force of a tension spring 104. The swinging arm 101 is formed at its right end with an arcuate enlarged portion 105 having a gear. This gear meshes with a driving gear 106 fixed to the output shaft of a lateral feed stepping motor 90 fixed to the base plate 40. Accordingly, when the swinging arm 101 is rotated about the pin 102 through the driving gear 106 by the lateral feed stepping motor 90, the output portion 103 is swung. As a result, the pin 100, that is, the movable member 93 is moved right and left, and the feed dog 48 is accordingly moved right and left through the second swinging member 65, the connecting member 70 and the driving pin 79. Such a lateral movement of the feed dog 48 causes lateral feed of the work fabric W.

Figure 12:
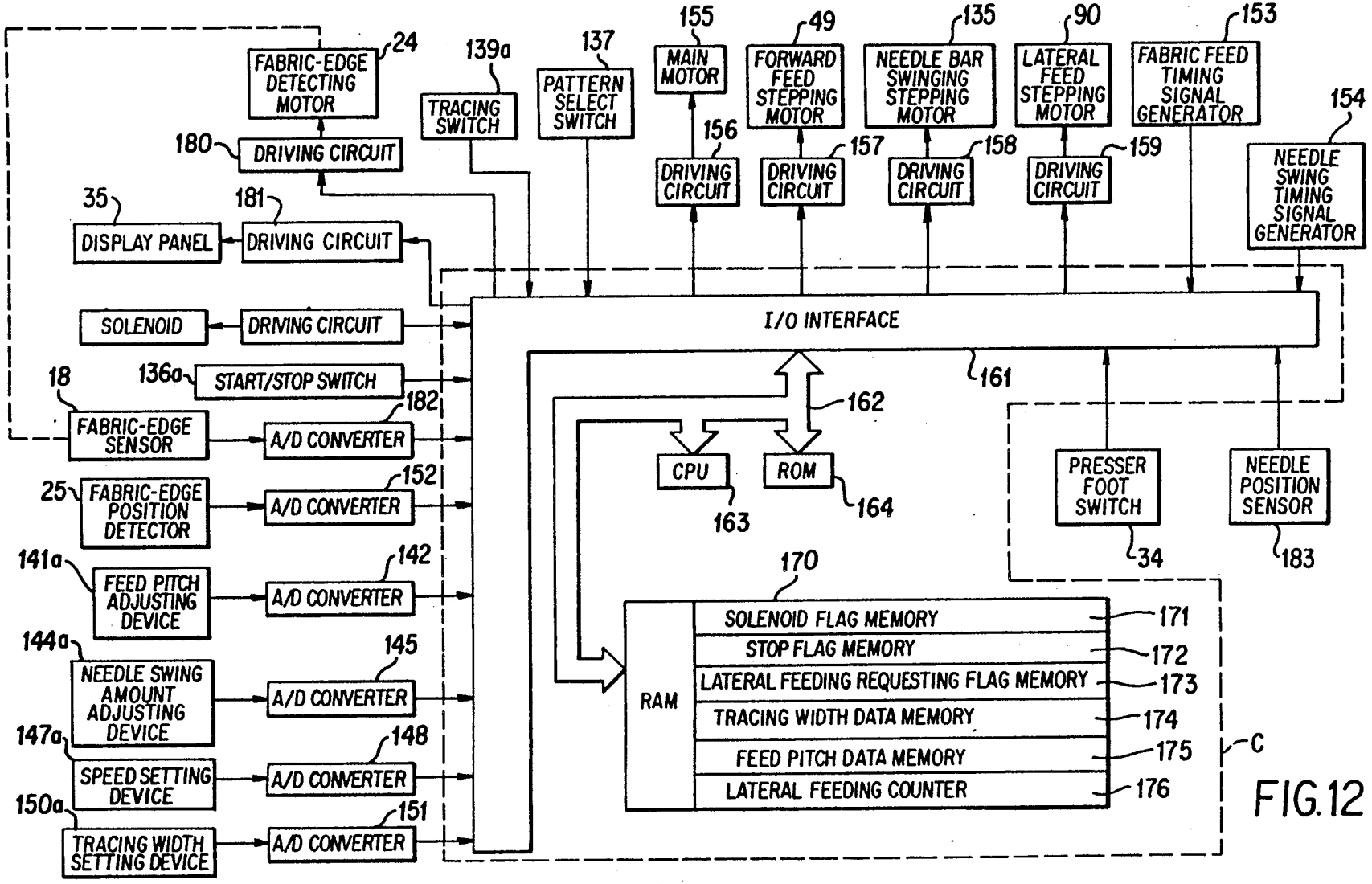
FIG. 12 is a block diagram of a control system of the sewing machine.

There will now be described a control system of the sewing machine M with reference to FIG. 12. A control device C includes an I/O interface 161 connected through driving circuits 156, 157, 158, 159, 160, 180 and 181 to the main motor 155, the forward feed stepping motor 49, the stepping motor 135 for swinging the needle bar, the lateral feed stepping motor 90, the solenoid 124, the fabric-edge detecting motor 24 and the display panel 35, respectively. The I/O interface 161 is also connected through A/D converters 142, 145, 148, 151, 152 and 182 to a feed pitch adjusting device 141*a*, a needle swing amount adjusting device 144*a*, a speed setting device 147*a*, a tracing width setting device 150*a*, the fabric-edge position detector 25 and the fabricedge sensor 18, respectively. Further, the I/O interface 161 is also connected to a start/stop switch 136*a*, the pattern select switch 137, a tracing switch 139*a*, a fabric feed timing signal generator 153, a needle swing timing signal generator 154, the presser foot switch 34 and the needle position sensor 183.

The control device C is constituted from a CPU (central processing unit) 163, and the I/O interface 161, an ROM 164 and an RAM 170 all connected to the CPU 163 by way of a bus 162 such as a data bus.

The ROM 164 has the following data and programs stored in advance therein.

(1) Stitch pattern data which are needle position data for individual sewing operations stored for each of a large number of stitch patterns of characters, symbols, marks and so forth in a corresponding relationship to respective pattern numbers.

(2) A control program for controlling drive of the main motor 155 in response to a preset speed signal received from the speed setting device 147*a* and a starting signal and a stopping signal received from the start/stop switch 136*a*.

(3) Another control program for controlling, in accordance with selected pattern data, the needle bar swinging stepping motor 135 at a needle swinging timing and controlling the forward feed stepping motor 49 and the lateral feed stepping motor 90 at a feeding timing.

(4) A fabric-edge tracing control program which is started in response to a tracing signal from the tracing switch 139*a*.

The last-mentioned fabric-edge tracing control program involves the following data and subroutines.

(i) A needle bar controlling subroutine for fixing the needle bar 9 at the center of a swinging range of the needle bar 9 without permitting swinging motion of the needle bar 9.

(ii) Reference value data De corresponding to a threshold value of a received light amount by the photoelectric cell 20, utilized to let the infrared rays emitted from the light emitter 19 follow an edge of the work fabric W.

(iii) A fabric-edge detecting subroutine for providing an instruction of a driving amount and a driving direction to the fabric-edge detecting motor 24 so as to make substantially zero the difference between the reference value data De and a detection data Ds corresponding to a detection voltage Vs from the photoelectric cell 20 of the fabric-edge sensor 18.

Figure 13:
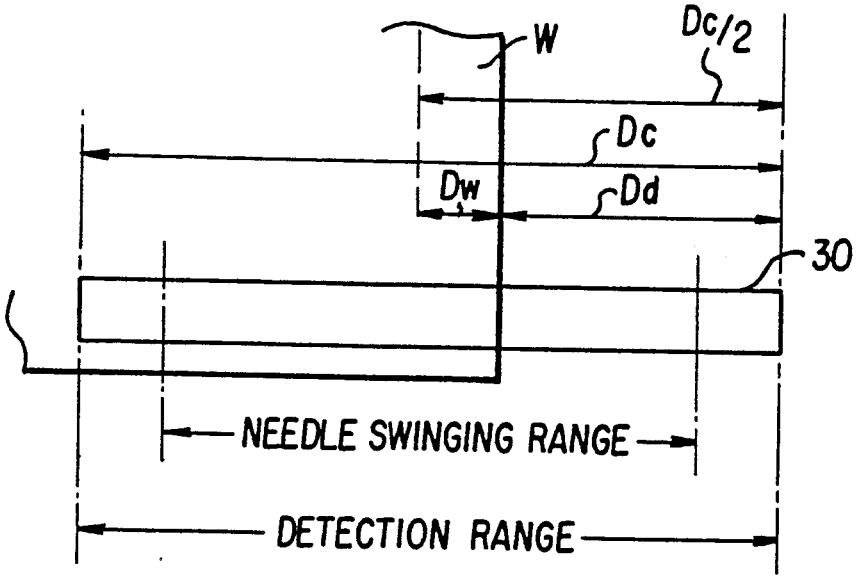
FIG. 13 is a schematic illustration of needle location control in a tracing sewing.

(iv) Detection range data Dc in accordance with a detection range corresponding to an entire width of the reflecting surface 30 as shown in FIG. 13.

(v) A calculation subroutine for calculating tracing width detection data Sw in accordance with $Sw=Dc/2-Dd$ from the equation of $Dc/2=Dw+Dd$, wherein Dw is the set tracing width data corresponding to a tracing width voltage Vw received from the tracing width setting device 150*a*, and Dd is fabric-edge position data corresponding to a fabric-edge position voltage Vd received from the fabric-edge position detector 25.

(vi) A maximum lateral feed pitch A (for example, about 0.6 mm) of the lateral feed stepping motor 90, and a set value S (for example, about 0.5 mm) as a tracing tolerance value smaller than the maximum lateral feed pitch A.

The RAM 170 has provided therein a solenoid flag memory 171 for storing therein a solenoid flag LF which is set when the solenoid 124 is driven, a stop flag memory 172 for storing therein a stop flag SF which is set when the main motor 155 is stopped, a lateral feeding requesting flag memory 173 for storing therein a lateral feeding requesting flag YF which is set when the work fabric W is turned in the course of tracing sewing, a tracing width data memory 174 for storing set tracing width data Dw therein, a feed pitch data memory 175 for storing feed pitch data B for forward feeding of the work fabric W therein, a lateral feeding counter 176 for counting a number of lateral feeding operations (the count value of which is represented by I), and various memories for temporarily storing therein results of calculations executed by the CPU 163. It is to be noted that the count value I of the lateral feeding counter 176 presents a value FF(HEX) when it is decreased after it has been cleared.

Figure 14A:
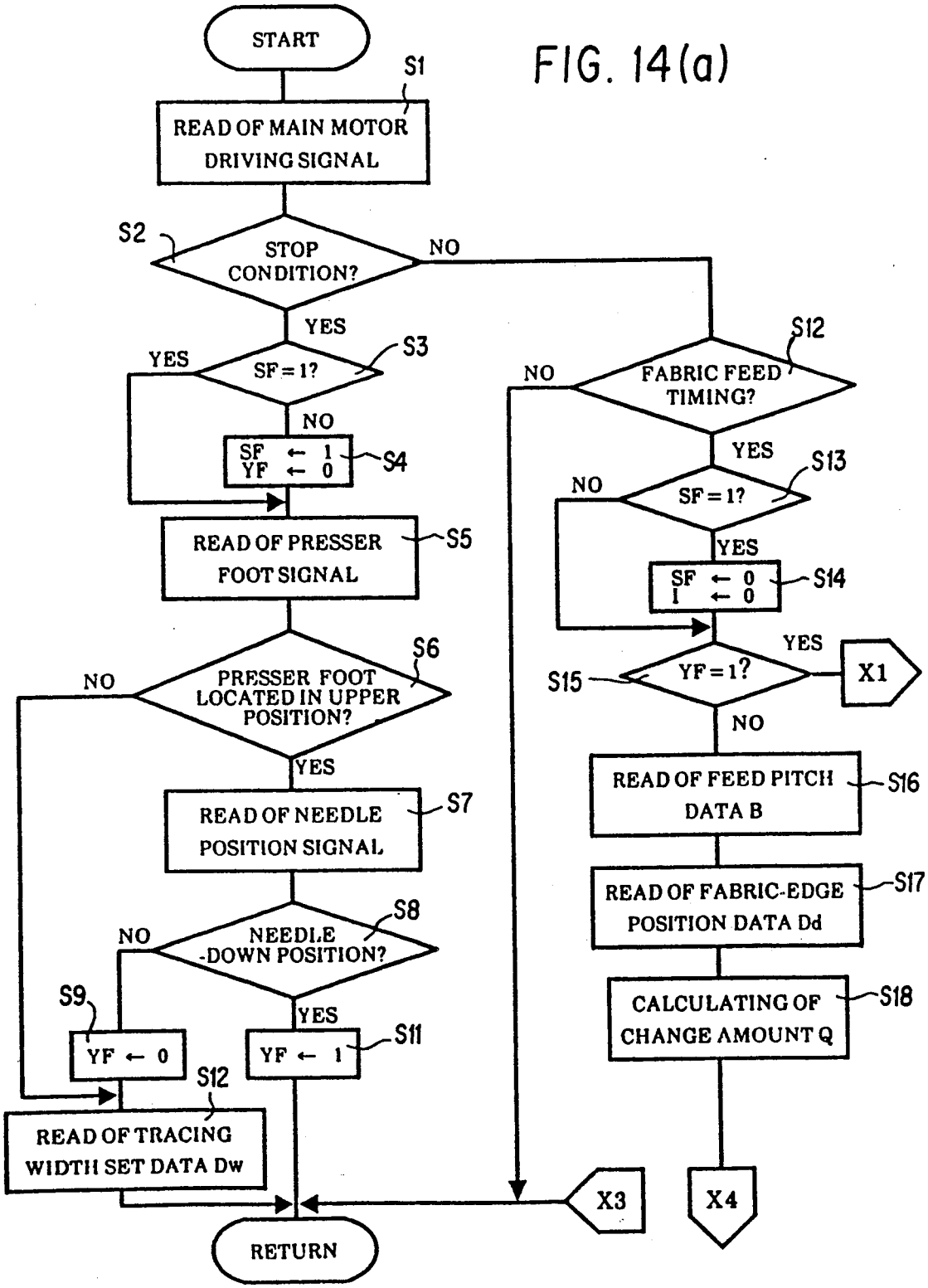
FIGS. 14(*a*), 14(*b*), and 14(*c*) are schematic flowcharts of a routine of fabric-edge tracing control.
Figure 14B:
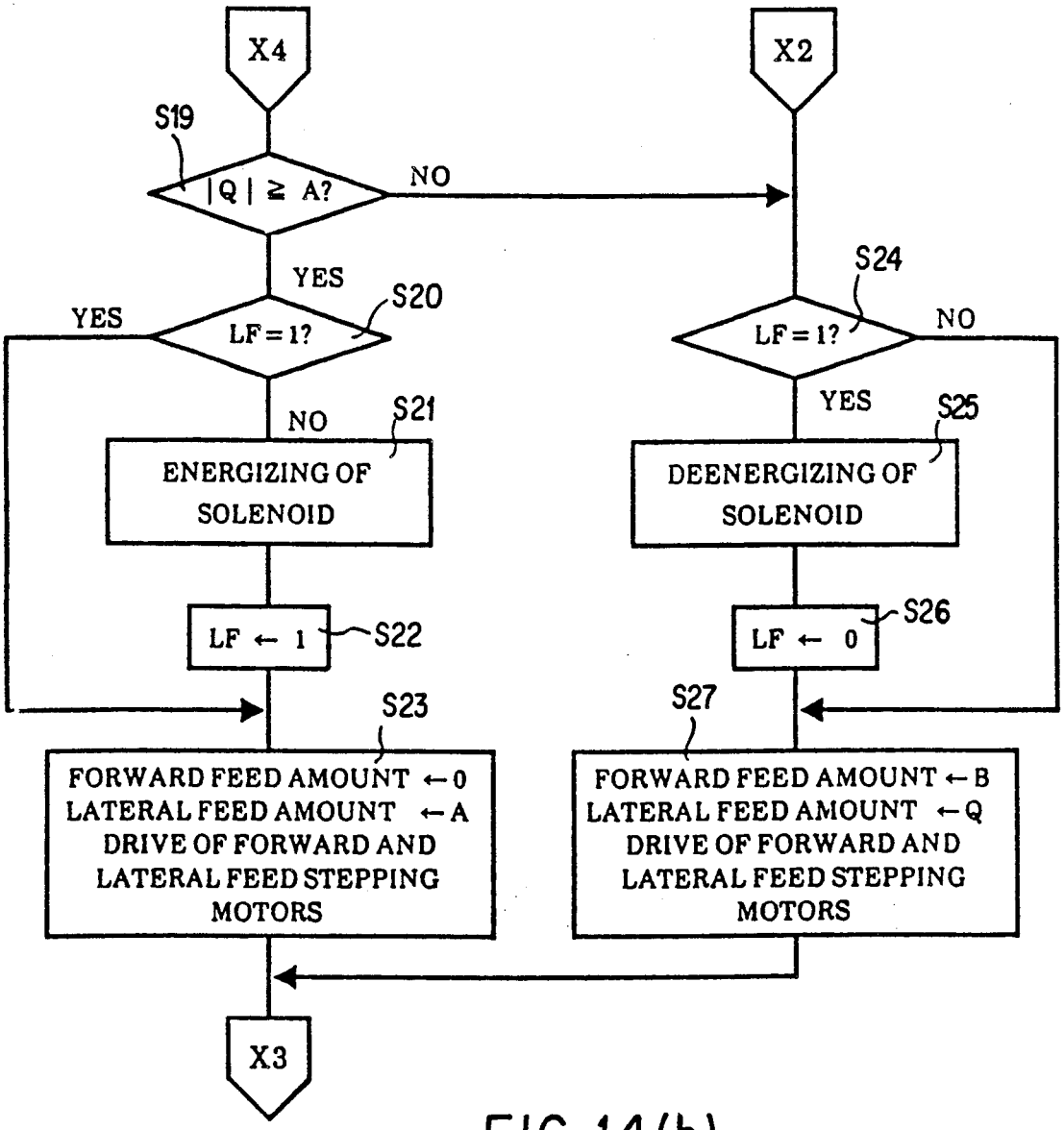
Figure 14C:
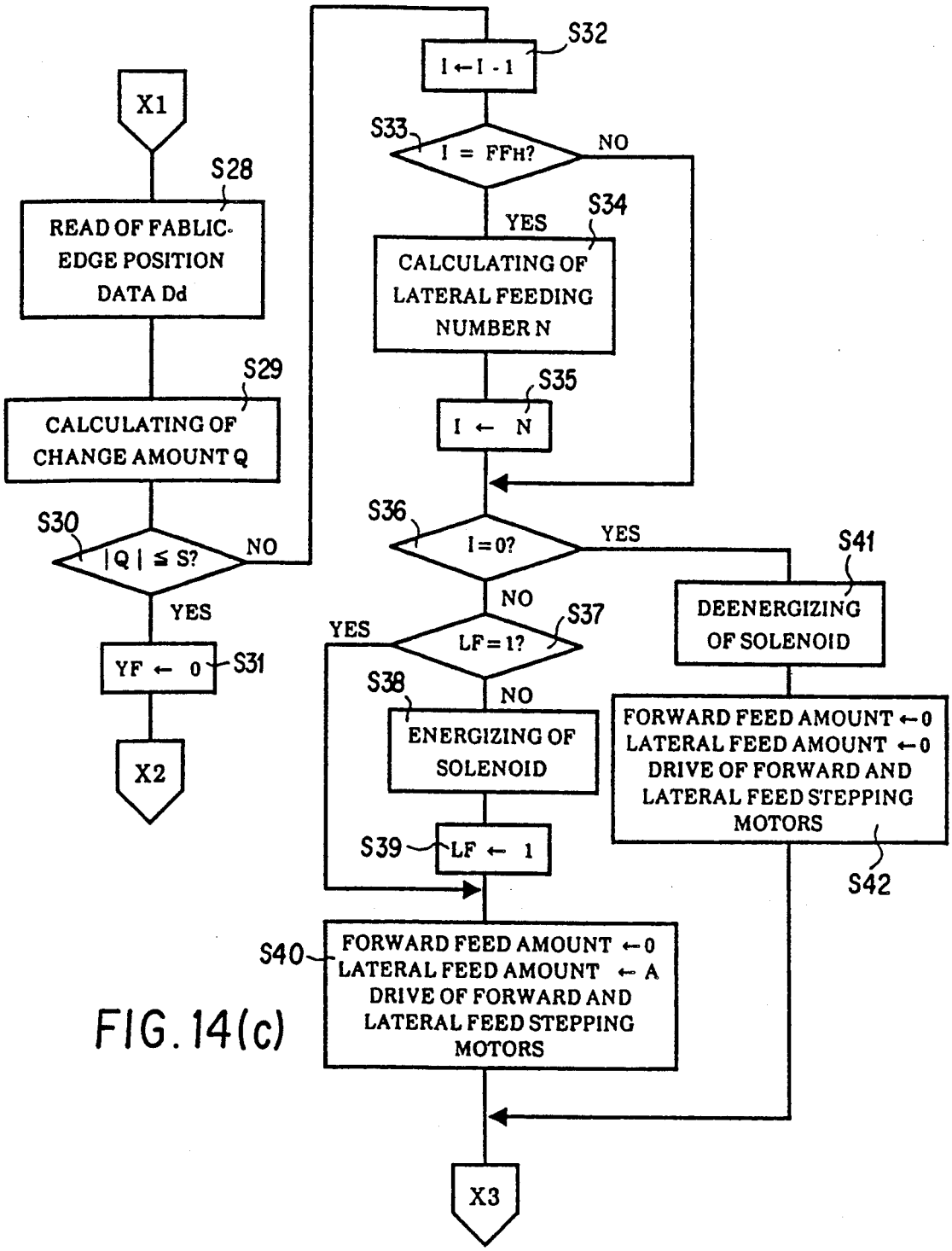

Subsequently, a routine of fabric-edge tracing control executed by the control device C of the sewing machine M will be described with reference to flow charts of FIGS. 14(*a*), 14(*b*), and 14(*c*). It is to be noted that reference character Si (i=1, 2, 3, . . . ) in FIGS. 14(*a*), 14(*b*), and 14(*c*) denotes a step number. The control is executed for each fraction of time, wherein forward feeding and lateral feeding of the work fabric W are executed at a fabric feed timing. It is to be noted that, when the present control is started, straight stitch is mandatorily selected.

If the tracing stitch 139*a* is changed over to a tracing mode, then the fabric-edge sensor 18 is controlled so as to follow an edge of the work fabric W in accordance with a fabric-edge detecting subroutine and fabric-edge tracing control is started. In case the sewing machine M is in a stop condition in accordance with a driving signal outputted to the main motor 155 (S1–S2), it is judged whether or not the stop flag SF is in a set state (S3). Since the stop flag SF is in a reset state upon starting of the fabric-edge tracing control, the stop flag SF is set and the lateral feeding requesting flag YF is reset (S4). Then, if it is judged based on a pressure foot signal from the pressure foot switch 34 that the pressure foot 32 is in the upper position (S5, S6) and, in addition, it is judged based on a needle position signal from the needle position sensor 183 that the sewing needle 10 is in the needle-up position (S7, S8), or in other words, when new tracing sewing is to be started, the lateral feeding requesting flag YF is reset (S9), and then set tracing width data Dw is read and stored into the tracing width data memory 174 and indicated on the display panel 35 (S10). Then, the program is returned.

After the main motor 155 is driven in accordance with a driving signal outputted to the main motor 155 to start tracing sewing (S1–S2), when a fabric feed timing signal is generated by the fabric feed timing signal generator 153 (S12), the stop flag SF is reset and the count value I of the lateral feeding counter 176 is cleared (S13–S14). Since the lateral feeding requesting flag YF is not in a set state (S15), feed pitch data B is read in accordance with a feed pitch adjusting signal from the feed pitch adjusting device 141*a* and stored into the feed pitch data memory 175 (S16), and then the fabric-edge position data Dd is read in accordance with the fabric-edge position voltage Vd from the fabric-edge position detector 25 (S17). Then, tracing width detection data Sw is calculated from the detection range data Dc stored in the ROM 164 and fabric-edge position data Dd, and then a difference between the tracing width detection data Sw and the set tracing width data Dw set by the tracing width setting device 150*a*, that is, a change amount Q in tracing width is calculated (S18). After then, a needle location in tracing sewing is determined at steps S19 to S27. In particular, when the change amount Q is equal to or greater than the maximum lateral feed pitch A, the solenoid 124 is energized and the solenoid flag LF is set (S20–S22). As a result, the slide plate 128 is moved leftwardly and held at a position at which it can be engaged with the clutch plate 117. Then, the forward feed stepping motor 49 is driven so that a forward feed amount may be equal to "0" and the lateral feed stepping motor 90 is driven so that a lateral feed amount may be equal to the maximum lateral feed pitch A (S23). Then, the program is returned. When the phase of the arm shaft 44 becomes substantially equal to 0 degree and the needle 10 reaches its upper most position during execution of lateral feeding of the work fabric W, the slide plate 128 and the clutch plate 117 are engaged with each other so that vertical reciprocation of the needle 10 and the thread takeup laver 122 is stopped. Then, when the steps S19 to S23 are repeated until the change amount Q becomes smaller than the maximum lateral feed pitch A, the solenoid 124 is deenergized and the solenoid flag LF is reset (S24–S26). Consequently, the slide plate 128 is returned to its inoperative position to disengage the slide plate 128 from the clutch plate 117. Then, the forward feed stepping motor 49 is driven so that the forward feed amount may be equal to the feed pitch B stored in the feed pitch data memory 175 and the lateral feed stepping motor 49 is driven so that the lateral feed amount may be equal to the change amount Q (S27). It is to be noted that, during execution of feeding of the work fabric W, the recess 112 of the set collar 111 and the projection 118 of the clutch plate 117 are engaged with each other to start up vertical reciprocation of the needle 10 and the thread take-up lever 122 to start tracing sewing.

Figure 15:
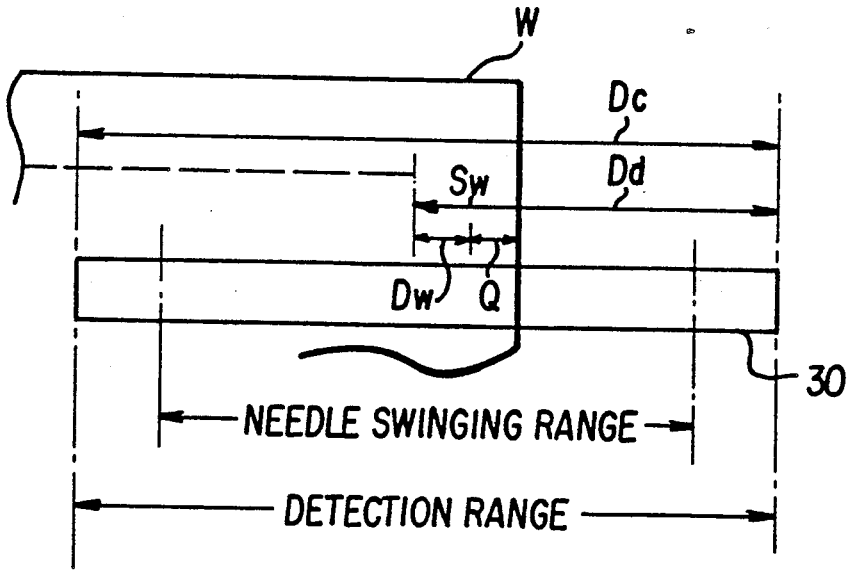
FIGS. 15 and 16 are illustrations corresponding to FIG. 13, showing tracing a corner portion of a work fabric.

Meanwhile, if the pressure bar 31 is changed over to its upper position after tracing sewing has been interrupted with the work fabric W pierced by the sewing needle 10 in order to perform tracing sewing, for example, of a corner of the right angle of the work fabric W as shown in FIG. 13, then the judgments at steps S6 and S8 are "Yes", and the lateral feeding requesting flag YF is set (S11). Then, if th work fabric W is turned, for example, by 90 degrees in the counterclockwise direction as shown in FIG. 15 and then tracing sewing is resumed, then the judgment at step S15 is "Yes". Thus, fabric-edge position data Dd is read (S28), and then tracing width detection data Sw is calculated based on the fabric-edge position data Dd and detection range data Dc stored in the ROM 164, and a change amount Q in tracing width is calculated (S29). If the change amount Q in tracing width is equal to or smaller than a set value S stored in the ROM 164, the lateral feeding requesting flag YF is reset (S30, S31), whereafter steps beginning with the step S24 are executed. To the contrary, in case the change amount Q in tracing width is greater than the set value S as shown, for example, in FIG. 15, it is preferable from the point of an appearance of the work fabric W to form, even after the work fabric W has been turned, stitches with the feed pitch B rightwardly in the lateral direction. Accordingly, steps S32 to S40 are subsequently executed. In particular, in case the count value I of the lateral feeding counter 176 is decreased to FF(HEX), that is, when lateral feeding is to be started (S32, S33), a lateral feeding number N is calculated by division of the feed pitch data B by the maximum lateral feed pitch A and is stored as the count value I into the lateral feeding counter 176 (S34, S35). Then, the solenoid 124 is energized and the solenoid flag LF is set (S36 to S39), and then the forward feed stepping motor 49 and the lateral feed stepping motor 90 are driven so that the forward feed amount may be equal to "0" and the lateral feed amount may be equal to the maximum lateral feeding pitch A (S40), then, the program is returned. After then, each time a fabric feed timing signal is generated from the fabric feed timing signal generator 153, the lateral feed control at steps S12 to S15 and S28 to S40 is repeated to perform lateral feeding so that the difference between the tracing width detection data Sw and the set tracing width data Dw may be canceled. Then, if the count value I is reduced to "0" (S36), the solenoid 124 is deenergized, and the forward feed stepping motor 49 and the lateral feed stepping motor 90 are individually driven so that the forward feed amount and the lateral feed amount may both be equal to "0" to form stitches (S41, S42).

Figure 16:
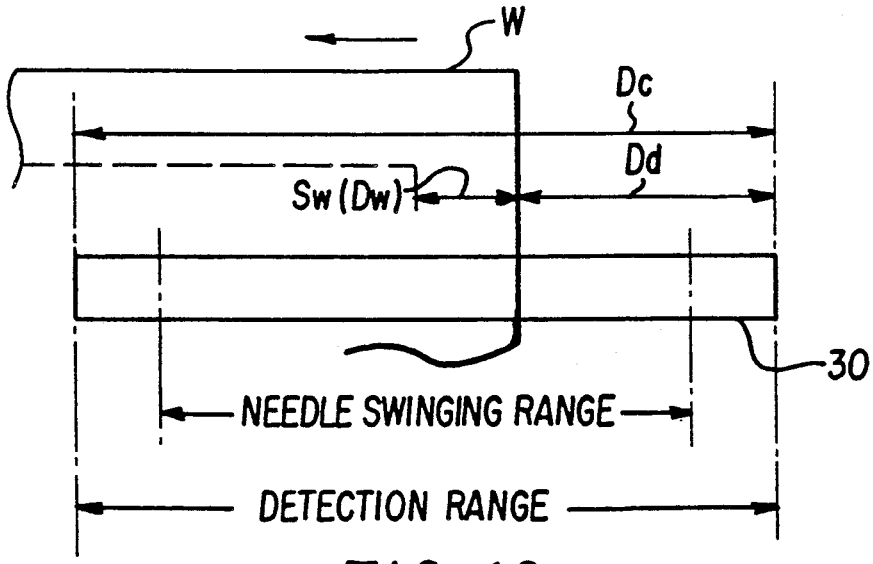

After then, if the tracing width detection data Sw becomes substantially equal to the preset tracing width data Dw as shown in FIG. 16 and hence the change amount Q in tracing width becomes smaller than the set value S (S30), the lateral feed requesting flag YF is reset (S31), and the steps beginning with step S24 are executed. Also when the change amount Q in tracing width becomes smaller than the set value S during execution of lateral feeding control, the steps beginning with step S24 are executed in a similar manner as described above.

As described so far, in case the distance Sw from the needle 10 to an edge of the work fabric W after the work fabric W has been turned around the needle 10 is different from the set tracing width Dw, tracing sewing is resumed after corrective sewing has been performed, and accordingly, accurate tracing sewing can be performed along a corner of the work fabric W.

Figure 17:
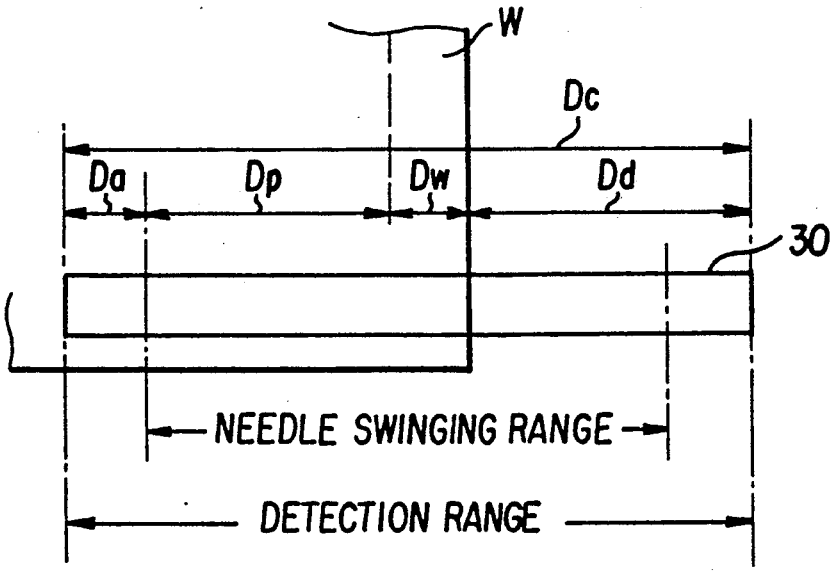
FIG. 17 is a schematic illustration of needle location control in case of applying the present invention to a sewing machine not provided with a lateral feed driving device.

It is to be noted that the present invention can be applied to an electronically controlled zigzag sewing machine which is not equipped with lateral feed device. In this instance, reference data Da corresponding to a difference between the detection range and a range of swinging motion of the needle 10 shown in FIG. 17 is stored in the ROM 164 in advance. Then, the CPU 163 calculates a distance from a left end of the range of swinging motion of the needle 10 to a position at which a stitch is to be formed, that is, needle position data Dp in accordance with an expression $Dp=Dc-Dd-Da-Dw$. Then, the CPU 163 drives the needle bar swinging stepping motor 135 in accordance with the needle position dat Dp to perform tracing sewing of an edge of the work fabric W. In case the main motor 155 is stopped near a corner of the work fabric W and then the work fabric W is turned around the sewing needle 10, the CPU 163 calculates needle position data Dp. Then, the CPU 163 drives main motor 155 and drives the needle bar swinging stepping motor 135 in accordance with the needle position data Dp to swing the needle 10 and drives the forward feed stepping motor 49 so that the forward feed amount may be equal to 0 thereby to perform corrective sewing. Since the distance Sw from the sewing needle 10 to an edge of the work fabric W becomes substantially equal to the set tracing width Dw as a result of the performance of such corrective sewing, accurate stitches of tracing sewing can be formed along the edge of the work fabric W even after tracing sewing is resumed.

What is claimed is:

1. An edge tracing sewing machine comprising:

a reciprocable needle bar having a needle at a lower end thereof;

feeding means for feeding a workpiece in a sewing direction synchronously with a reciprocation of said needle bar;

relative position changing means for changing the relative position between the needle and the workpiece in a lateral direction perpendicular to the sewing direction;

edge position detecting means for detecting an edge position of the workpiece in the lateral direction, and generating an edge position signal;

tracing width setting means for setting a tracing width from the edge of the workpiece to the needle in the lateral direction;

first control means for controlling said relative position changing means based on the edge position signal generated by said edge position detecting means and the tracing width set by said tracing width setting means, so as to carry out a tracing sewing with the set tracing width;

interruption detecting means for detecting an interruption of the tracing sewing in a vicinity of a corner portion of the workpiece so as to rotate the workpiece and to change the sewing direction; and second control means for nullifying said feeding means and controlling said relative position changing means based on the edge position signal generated by said edge position detecting means and the tracing width set by said tracing width setting means after the interruption of the tracing sewing is detected by said interruption detecting means, whereby a difference between a distance from the edge of the workpiece to the needle after said interruption and the set tracing width is reduced.

2. The edge tracing sewing machine according to claim 1, wherein said relative position changing means comprises lateral feeding means for feeding the workpiece in the lateral direction perpendicular to the sewing direction.

3. The edge tracing sewing machine according to claim 1, wherein said relative position changing means comprises needle swinging means for swinging the needle in the lateral direction perpendicular to the sewing direction.

4. The edge tracing sewing machine according to claim 1, further comprising:

corrective sewing means for driving said needle bar as the second control means controls said relative position changing means to reduce the difference between the distance from the edge of the workpiece and the set tracing width.

5. The edge tracing sewing machine according to claim 4, wherein said corrective sewing means includes means for driving said needle bar each time the relative position between the needle and the workpiece is changed with a distance corresponding to a feed pitch of said feeding means by said second control means.

6. The edge tracing sewing as in claim 5, wherein the second control means includes means for determining a lateral feed count based on the ratio of a feed pitch of the feeding means and a feed pitch of the relative position changing means and means for controlling the relative position changing means in accordance with said count.

7. The edge tracing sewing machine according to claim 4, further comprising:

means for reciprocating said reciprocable needle bar;

means for driving said reciprocating means;

clutch means coactive between the reciprocating means and the drive means for engaging and disengaging said reciprocating means from said drive means; and wherein the corrective sewing means controls said clutch means to start and stop reciprocation of the needle bar.

8. An edge tracing sewing machine comprising:

a reciprocable needle bar having a needle at a lower end thereof;

needle position detecting means for detecting needle-down position wherein the needle pierces the workpiece;

a presser bar having a pressure foot at a lower end thereof, movable between an upper position wherein the pressure foot is apart from the workpiece and lower position wherein the presser foot presses the workpiece;

presser bar position detecting means for detecting the upper position of said presser bar;

feeding means for feeding a workpiece in a sewing direction synchronously with reciprocation of said needle bar;

relative position changing means for changing the relative position between the needle and the workpiece in a lateral direction perpendicular to the sewing direction;

edge position detecting means for detecting an edge position of the workpiece in the lateral direction, and generating an edge position signal;

tracing width setting means for setting a tracing width from the edge of the workpiece to the needle in the lateral direction;

first control means for controlling said relative position changing means based on the edge position signal generated by said edge position detecting means and the tracing width set by said tracing width setting means, so as to carry out a tracing with the set tracing width; and second control means for nullifying said feeding means based on detection signals from said needle position detecting means and said presser bar position detecting means and controlling said relative position changing means based on the edge position signal generated by said edge position detecting means and the tracing width set by said tracing width setting means, whereby a difference between a distance from the edge of the workpiece to the needle after said interruption and the set tracing width is reduced.

9. The edge tracing sewing machine according to claim 8, wherein said relative position changing means comprises lateral feeding means for feeding the workpiece in the lateral direction perpendicular to the sewing direction.

10. The edge tracing sewing machine according to claim 9, wherein said relative position changing means comprises needle swinging means for swinging the needle in the lateral direction perpendicular to the sewing direction.

11. The edge tracing sewing machine according to claim 8, further comprising:

corrective sewing means for driving said needle bar as the second control means controls said relative position changing means to reduce the difference between the distance from the edge of the workpiece and the set tracing width.

12. The edge tracing sewing machine according to claim 11, wherein said corrective sewing means includes means for driving said needle bar each time the relative position between the needle and the workpiece is changed with a distance corresponding to a feed pitch of said feeding means by said second control means.

13. The edge tracing sewing as in claim 12, wherein the second control means includes means for determining a lateral feed count based on the ratio of a feed pitch of the feeding means and a feed pitch of the relative position changing means and means for controlling the relative position changing means in accordance with said count.

14. An edge tracing sewing machine comprising:

a reciprocable needle bar having a needle at a lower end thereof;

feeding means for feeding a workpiece in a sewing direction synchronously with a reciprocation of said needle bar;

relative position changing means for changing the relative position between the needle and the workpiece in a lateral direction perpendicular to the sewing direction;

edge position detecting means for detecting an edge position of the workpiece in the lateral direction, and generating an edge position signal;

tracing width setting means for setting a tracing width from the edge of the workpiece to the needle in the lateral direction;

first control means for controlling said relative position changing means based on the edge position signal generated by said edge position detecting means and the tracing width set by said tracing width setting means, so as to carry out a tracing sewing with the set tracing width;

means for detecting reorientation of the workpiece with respect to the needle; and second control means for nullifying said feeding means and controlling said relative position changing means based on the edge position signal generated by said edge position detecting means and the tracing width set by said tracing width setting means after the reorientation of the workpiece is detected by said reorientation detecting means, whereby a difference between a distance from the edge of the workpiece to the needle after said reorientation and the set tracing width is reduced.

15. The edge tracing sewing machine according to claim 14, wherein said relative position changing means comprises lateral feeding means for feeding the workpiece in the lateral direction perpendicular to the sewing direction.

16. The edge tracing sewing machine according to claim 14, wherein said relative position changing means comprises needle swinging means for swinging the needle in the lateral direction perpendicular to the sewing direction.

17. The edge tracing sewing machine according to claim 14, further comprising:

corrective sewing means for driving said needle bar as the second control means controls said relative position changing means to reduce the difference between the distance from the edge of the workpiece and the set tracing width.

18. The edge tracing sewing machine according to claim 17, wherein said corrective sewing means includes means for driving said needle bar each time the relative position between the needle and the workpiece is changed with a distance corresponding to a feed pitch of said feeding means by said second control means.

19. The edge tracing sewing as in claim 18, wherein the second control means includes means for determining a lateral feed count based on the ratio of a feed pitch of the feeding means and a feed pitch of the relative position changing means and means for controlling the relative position changing means in accordance with said count.

* * * * *.